US010549955B2

(12) United States Patent
Zappa

(10) Patent No.: US 10,549,955 B2
(45) Date of Patent: Feb. 4, 2020

(54) METHOD FOR THE MANUFACTURE OF A SILL FOR A LIFT DOOR AND SILL

(71) Applicant: SEMATIC S.p.A., Osio Sotto, Bergamo (IT)

(72) Inventor: Roberto Zappa, Bergamo (IT)

(73) Assignee: SEMATIC S.p.A., Osio Sotto, Bergamo (IT)

( * ) Notice: Subject to any disclaimer, the term of this patent is extended or adjusted under 35 U.S.C. 154(b) by 121 days.

(21) Appl. No.: 15/529,360

(22) PCT Filed: Oct. 30, 2015

(86) PCT No.: PCT/IB2015/058408
§ 371 (c)(1),
(2) Date: May 24, 2017

(87) PCT Pub. No.: WO2016/083922
PCT Pub. Date: Jun. 2, 2016

(65) Prior Publication Data

US 2017/0305720 A1 Oct. 26, 2017

(30) Foreign Application Priority Data

Nov. 27, 2014 (IT) ..... BG2014A0051

(51) Int. Cl.
*B66B 13/30* (2006.01)
*B66B 13/08* (2006.01)

(52) U.S. Cl.
CPC ..... *B66B 13/301* (2013.01); *B66B 13/08* (2013.01); *E05Y 2900/104* (2013.01)

(58) Field of Classification Search
CPC .. B66B 13/301; B66B 13/08; E05Y 2900/104
See application file for complete search history.

(56) References Cited

U.S. PATENT DOCUMENTS 1,715,188 A * 5/1929 Bullock ..... B66B 13/301 16/90
5,915,501 A * 6/1999 Lodi ..... B66B 13/301 187/333

(Continued)

FOREIGN PATENT DOCUMENTS

| | | |
|---|---|---|
| EP | 1 445 410 A1 | 8/2004 |
| GB | 2 387 164 A | 10/2003 |
| JP | H11-263565 A | 9/1999 |

OTHER PUBLICATIONS

International Search Report and Written Opinion of the International Searching Authority for corresponding International Patent Application No. PCT/IB2015/058408 dated Jan. 5, 2016, 9 pgs.

*Primary Examiner* — Diem M Tran
(74) *Attorney, Agent, or Firm* — Merchant & Gould P.C.

(57) ABSTRACT

A sill (1, 1') for a lift door is manufactured with a method that includes the steps of providing at least one support element (2) and an upper profile (4) that defines at least a boundary surface (6) of a first groove longitudinal (8) for slidingly receiving a lift door. The support element (2) and the upper profile (4) are joined, placing a first demarcation profile (10, 10') alongside the upper profile (4), so that a boundary surface (12) of the first demarcation profile delimits part of the first longitudinal groove (8). A sliding transversal cross-section of the first longitudinal groove (8) is adjusted by approaching/distancing the boundary surfaces (6, 12) and, having obtained a desired sliding transversal cross-section, constraining the mutual position of the first demarcation profile (10, 10') and of the upper profile (4).

14 Claims, 3 Drawing Sheets

(56) References Cited

U.S. PATENT DOCUMENTS

2008/0271960 A1 11/2008 Michaels
2017/0043980 A1* 2/2017 Yamamoto ..... B66B 13/301

* cited by examiner

METHOD FOR THE MANUFACTURE OF A SILL FOR A LIFT DOOR AND SILL

This application is a National Stage Application of PCT/IB2015/058408, filed 30 Oct. 2015, which claims benefit of Serial No. BG2014A000051, filed 27 Nov. 2014 in Italy and which applications are incorporated herein by reference. To the extent appropriate, a claim of priority is made to each of the above disclosed applications.

BACKGROUND OF THE INVENTION

This invention relates to a procedure for the manufacture of a sill for a lift door, and a sill for a lift door, for example manufactured according to the aforesaid method.

Document GB2387164, by the same applicant, discloses a door sill made of metal and a related manufacturing method.

The known system presented in this document mainly suffers from the drawback that the groove which serves as the guide for the door is obtained by a series of longitudinal bends of the same profile, such bends having to be carried out with care so that there is a satisfactory geometrical coupling with the other components of the sill.

Since each bend involves inevitable machining errors, it is not uncommon that there may be difficulties with the assembly of the different parts, with a consequent increase of production costs, but also with sliding of the leaves after the sill has been put in place.

SUMMARY OF THE INVENTION

This invention belongs in this context, proposing to provide a sill and a manufacturing method for a sill able to overcome the aforesaid drawbacks and, more specifically, suitable to provide sills for lift doors of high precision and reliability of operation.

BRIEF DESCRIPTION OF THE DRAWINGS

The object of this invention will now be described in detail, with the help of the accompanying drawings, in which:

FIG. 3 is a section along plane III-III indicated in the same figure;

DETAILED DESCRIPTION OF THE PREFERRED EMBODIMENTS

Figure 1:
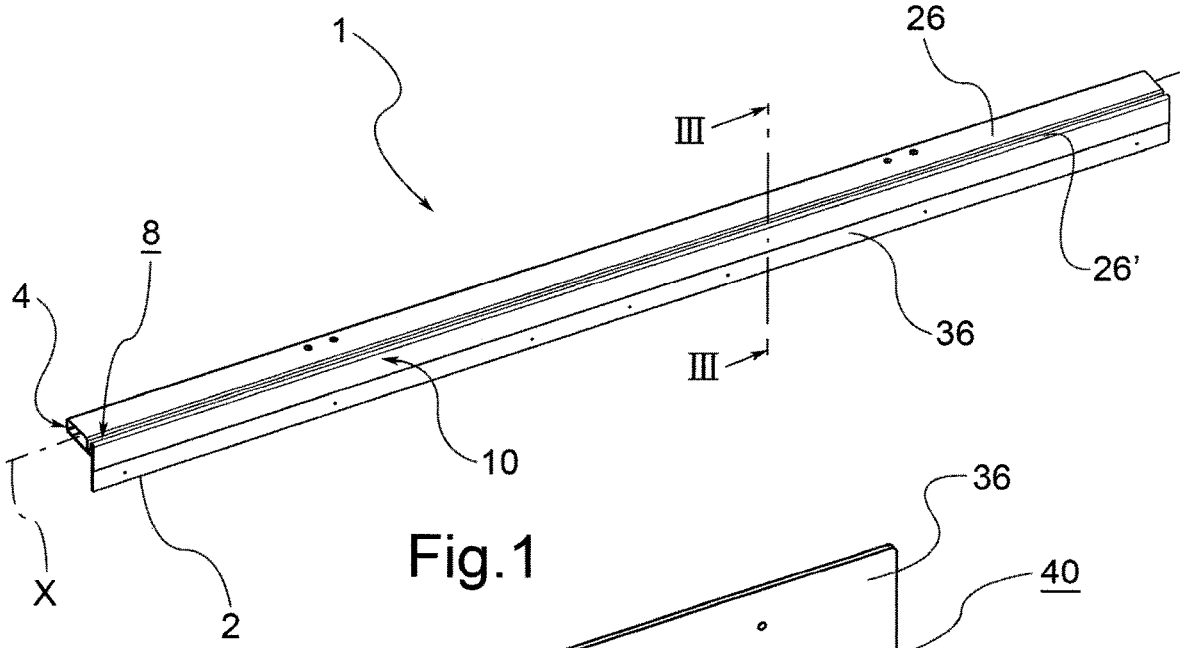
FIGS. 1, 2 and 3 respectively show a top perspective view, an enlarged bottom perspective view and a cross section of a sill for lift door covered by this invention, according to a first embodiment, where FIG. 2 corresponds to the highlighted area of FIG. 1, as said in opposed perspective.

The aforesaid objective is achieved by means of a procedure for the manufacture of a sill 1, 1' for lift door comprising a step of providing at least one support element 2 and an upper profile 4, which extends along a main direction of extension X and which defines at least a boundary surface 6 of a first longitudinal groove 8 for the slidable housing of a lift door, and a step of joining the support element 2 and the upper profile 4.

According to an advantageous embodiment, the sill 1, 1' comprises a single support element 2, preferably in the form of a profile which extends along or parallel to the main direction of extension X.

According to a preferred variant, the support element 2 has a substantially "L"-shaped cross section, i.e. a first 34 and a second 36 element arm mutually arranged in an incident manner, for example substantially at a right angle.

For example, in a plane orthogonal to the main direction of extension X, the element arms 34, 36 may be substantially the same length.

Optionally, in a plane orthogonal to the main direction of extension X, the second element arm 36 may be shorter than the first element arm 34.

According to a further variant, the upper profile 4 rests at least in part (for example completely) on the support element 2, and more precisely on the first arm 34.

According to a still further variant, the upper profile 4 may comprise a support portion 42, substantially planar, lying in abutment to the support element or to the first arm 34. For example, the support section 42 is made from a folded longitudinal edge of the upper profile 4.

According to a particularly advantageous variant, the upper profile 4 delimits a profile recess 48, which extends at least partly along the main direction of extension X.

Preferably, the profile recess 48 is delimited jointly by the upper profile 4 and by the support element 2, the latter for example in the form of a profile.

According to a preferred embodiment, the support element 2 delimits at least a passing adjustment slot 46, to which a locking nut 50 of the sill 1, 1' is attached to a lift shaft in a slidable manner.

According to a variant, the locking nut 50 is received in the profile recess 48.

Specifically, the locking nut 50 is joined to a sliding member 52 movable along the aforesaid slot 46. According to a possible variant, this member 52 may include one or more arms for hooking the edges of the passing adjustment slot.

For example, the sliding member could receive the locking nut 50 at least in part.

Figure 2:
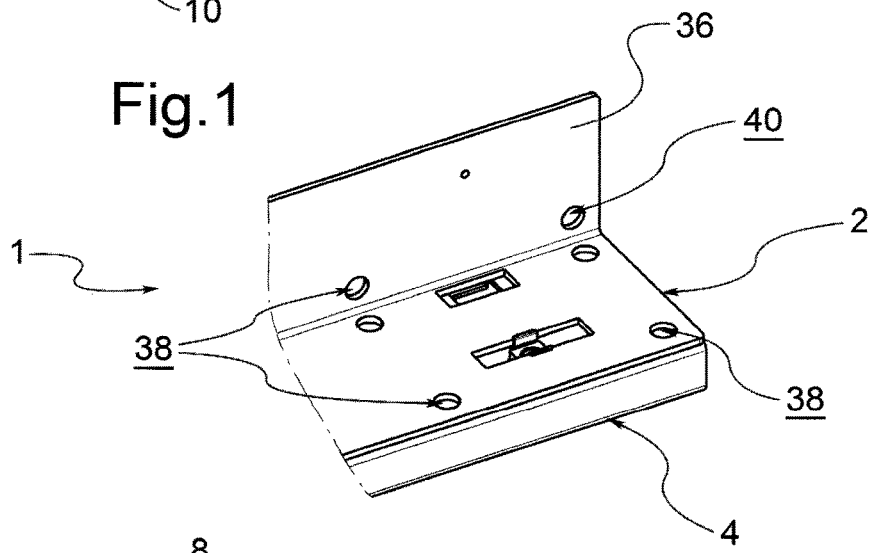
Figure 5:
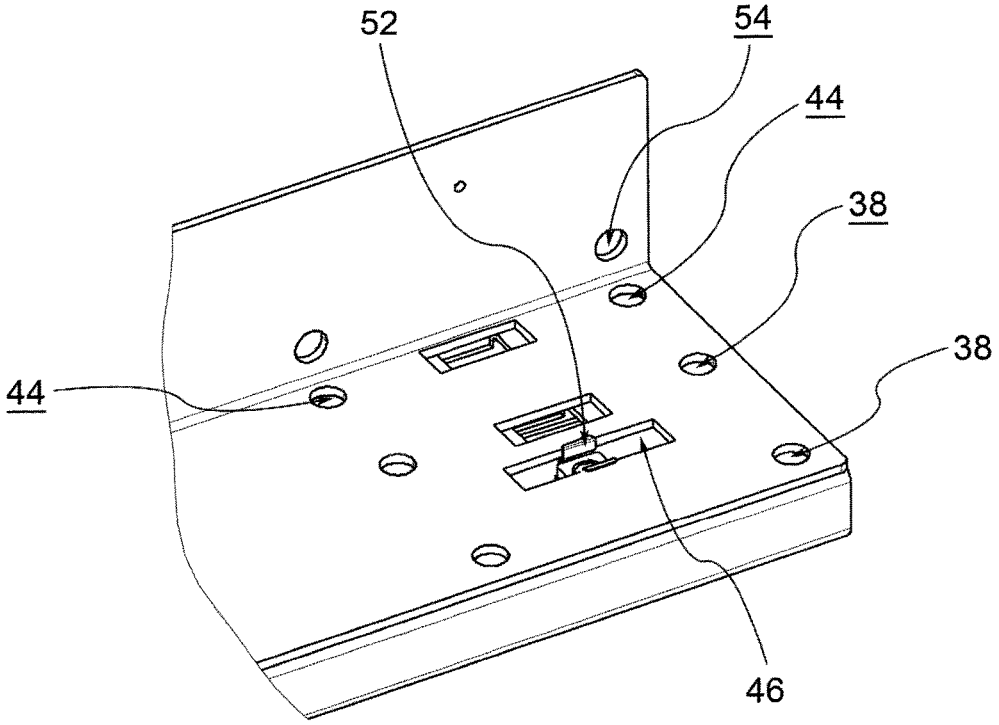

According to an embodiment, the support element 2 may be crossed by through openings 38, 40, 44, for example formed on the first arm 34 and/or on the second arm 36, spaced along the main direction of extension X and/or transversely to that direction. These openings are for example, clearly visible in FIGS. 2 and 5.

According to a non-illustrated embodiment, the support element 2 and the upper profile 4 are joined by means of screws, rivets or similar mechanical fastening means.

In this regard, according to a possible variant, the through openings 38, 40, 44 of the support element 2 may be internally threaded.

The step of joining the support element 2 and the upper profile 4 is advantageously carried out by welding, specifically through the first through openings 38 formed in the aforesaid element 2.

The method further comprises a step of placing a first demarcation profile 10, 10' alongside the upper profile 4, so that a boundary surface 12 of said first demarcation profile delimits part of the first longitudinal groove 8.

In other words, the first longitudinal groove 8 is laterally delimited by the boundary surface 6 of the upper profile 4, by the opposite boundary surface 12 of the first demarcation profile 10, 10' and, optionally, by a bottom surface 28 on a third side.

In the embodiment shown in the drawings, the bottom surface 28 is identified by the upper profile 4.

According to a preferred embodiment, the boundary surfaces 6, 12 are developed in a manner incident or orthogonal with respect to the bottom surface 28 of the first longitudinal groove 8.

In a subsequent step of the procedure, a sliding transversal cross-section of the first longitudinal groove 8 is adjusted by approaching and/or distancing the aforementioned boundary surfaces 6, 12.

Consequently, through operations of approaching/distancing the involved profiles, it is possible to obtain a desired cross-section or width of the first longitudinal groove.

Finally, once the desired transversal sliding cross-section has been obtained, the relative position of the first demarcation profile 10, 10' and of the upper profile 4 is constrained.

According to a non-illustrated embodiment, the demarcation profile 10, 10' and the upper profile 4 are joined by means of screws, rivets and/or welding.

As discussed above, in an embodiment the through openings 38, 40, 44 of the support element 2, interacting with the aforementioned screws, may be internally threaded.

The constraining step preferably comprises a step of joining the first demarcation profile 10, 10' (optionally, the second demarcation profile 22, discussed below) to the support element 2, advantageously by welding.

According to a first variant, the union/welding of the first demarcation profile 10 occurs through second through openings 40 of the support element 2, for example of the second element arm 36.

According to a second variant, the union/welding of the first demarcation profile 10' occurs through third through openings 44 of the support element 2, for example formed in the first element arm 34.

According to a third variant, the union/welding of the second demarcation profile 22 occurs through fourth through openings 54 of the support element 2, for example formed in the second element arm 36.

More precisely, the first demarcation profile 10 may be joined to the second element arm 36 of the support element 2.

Optionally, the first demarcation profile 10' and/or the second demarcation profile 22, may be joined to the first element arm 34 of the support element 2.

Preferably, the second demarcation profile 22 is joined to the second element arm 36 of the support element 2.

According to a particularly advantageous embodiment, the first demarcation profile 10, 10' and the upper profile 4 are shape-coupled to each other.

More precisely, according to a variant, the first demarcation profile 10, 10' receives the upper profile, at least in part.

Figure 3:
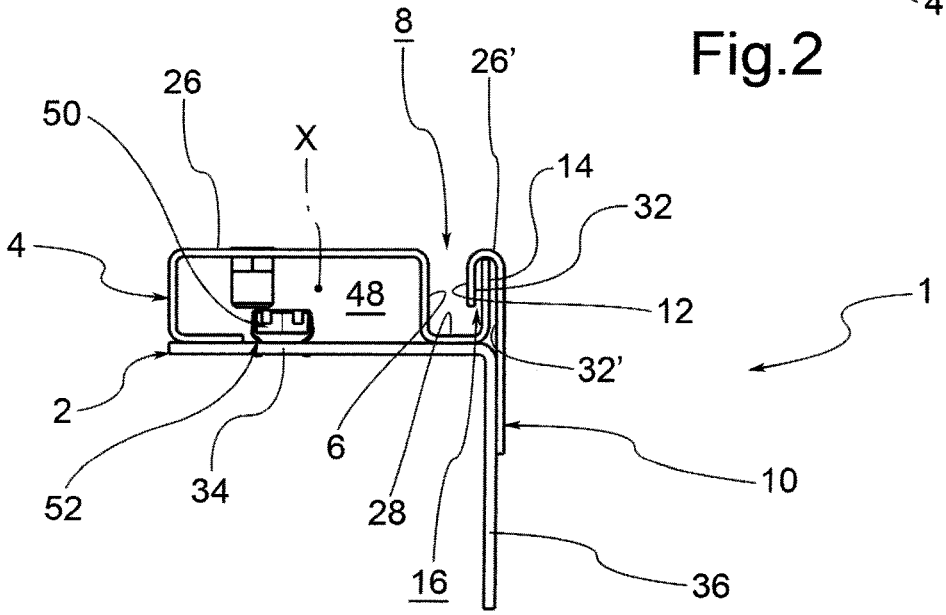
Figure 6:
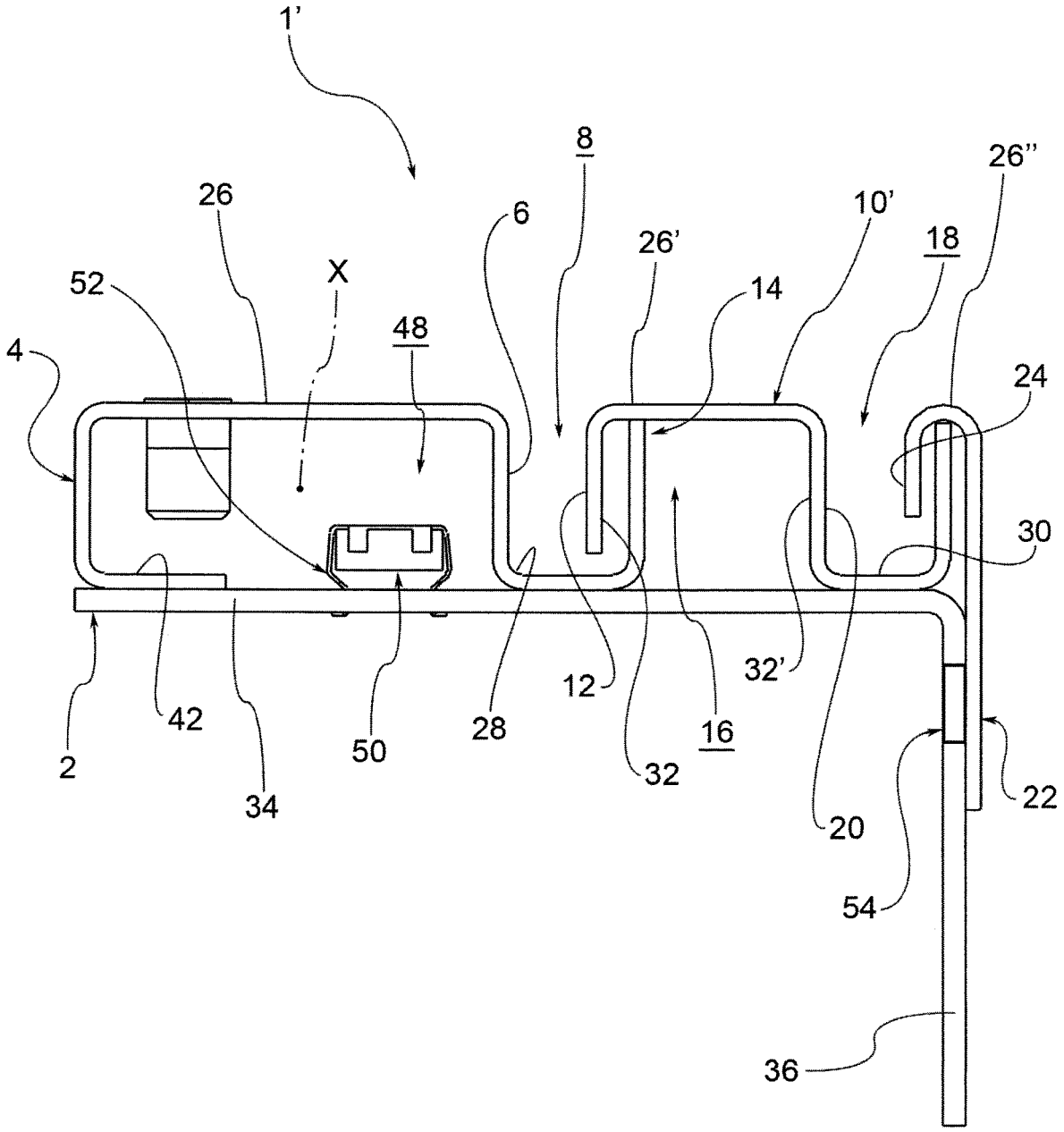

For example, as shown schematically in FIG. 3 or FIG. 6, the upper profile 4 may comprise a free edge 14, preferably oriented in a vertical direction in a condition of use of the sill 1, where the first demarcation profile 10, 10' may delimit a recess 16 in which the free edge 14 is at least partially received.

Preferably, the free edge 14 and the recess 16 are mutually shaped in such a way that, before the constraining step, the edge has a clearance inside the recess.

Mainly, this clearance allows finding a positioning and a fine adjustment of the two profiles side by side.

Advantageously, the dimensions of the free edge 14 and the recess 16 are related so that, before the constraining step, the edge has the aforesaid clearance inside the recess, for example in a transversal direction to the main direction of extension X.

In other words, the free edge and the recess are dimensionally related in such a way that the edge can be in contact with one surface 32, 32' delimiting the recess 16, or disposed in an intermediate position between these surfaces (as, for example, shown schematically in FIG. 6).

According to a particularly advantageous embodiment, the mouth of said recess 16 is oriented with respect to the free edge 14 so that, before the step of constraining, the first demarcation profile 10, 10' is hooked to the support element 2, but transversely movable to adjust the desired transversal sliding cross-section.

For example, the mouth of the aforesaid recess 16 is directed vertically downwards.

According to a further variant, the recess 16 of the first demarcation profile 10, 10' is made from a bent longitudinal portion of said profile.

Figure 4:
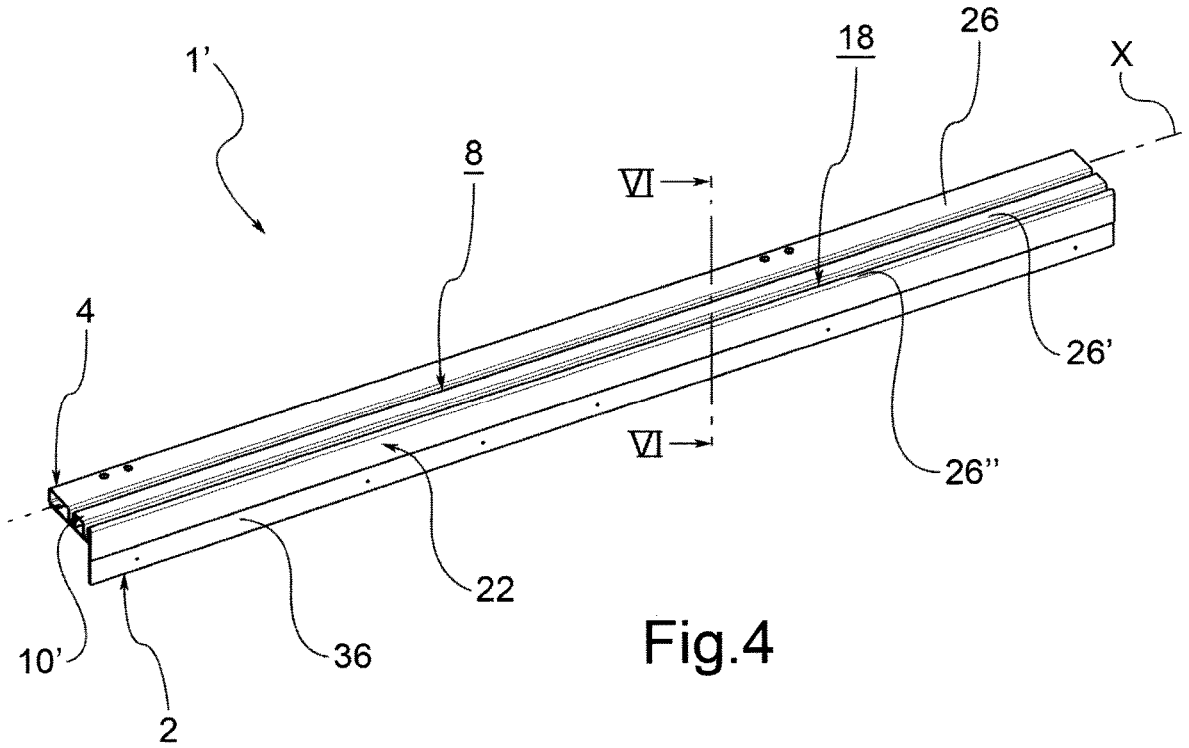
FIGS. 4, 5 and 6 are views corresponding to the previous of a sill covered by this invention, according to a further embodiment, the section of FIG. 6 being executed along plane VI-VI indicated in FIG. 4, the reverse perspective enlargement being relative to the area highlighted in the same figure.

According to a preferred variant, the first demarcation profile 10' may define at least a margin 20 of a second longitudinal groove 18 for slidingly receiving a second lift door. In this regard, refer to FIGS. 4 to 6.

According to this variant, the procedure preferably comprises the steps of placing a second demarcation profile 22 alongside the first demarcation profile 10', in such a way that a margin 24 of the second demarcation profile 22 defines part of the second longitudinal groove 18, adjusting a sliding transversal cross-section of the second longitudinal groove 18 by means of an approaching/distancing of the aforesaid margins 20, 24 and, having obtained the desired sliding transversal cross-section for such groove 18, constraining the mutual position of the demarcation profiles 10', 22 and, more precisely, of the second demarcation profile with respect to the first demarcation profile 10'.

In other words, the adjustment of the cross-section of the second longitudinal groove 18 takes place according to steps corresponding to those discussed in relation to the first longitudinal groove 8, although through the use of different profiles.

Therefore, preferably, the sliding transversal cross-sections of the first 8 and of the second 18 longitudinal groove are adjustable independently of each other.

According to an advantageous variant, the aforesaid margins 20, 24 may be developed in a manner incident or orthogonal with respect to the bottom surface 30 of the first longitudinal groove 18.

In the embodiment shown in the drawings, the bottom surface 30 is identified by the upper demarcation profile 10'.

According to a preferred variant, the first demarcation profile 10' and the second demarcation profile 22 are shape-coupled, preferably with a mutual clearance before constraining, as discussed with regard to the preceding variants.

Advantageously, the upper profile 4 and the demarcation profile, first 10, 10' and/or second 22, delimit walkable surfaces 26, 26', 26" of, the sill 1, 1'.

The purpose of this invention is further achieved by means of a sill 1, 1' for lift door, comprising the following features.

Since a preferred variant of this sill provides for an embodiment using the aforesaid procedure, even where this is not expressly indicated, this sill comprises all the features deducible from the preceding description. Of course, even the method may comprise implicit construction steps in the structural properties of the following sill.

This sill 1, 1' comprises:

an upper profile 4, which extends along a main direction of extension X and which defines at least one boundary surface 6 of a first longitudinal groove 8 for the slidable housing of a lift door;

at least a support element 2 joined to the upper profile 4;

a first demarcation profile 10, 10' alongside the upper profile 4, so that a boundary surface 12 of said demarcation profile delimits part of the first longitudinal groove 8;

wherein the sliding transversal cross-section of the first longitudinal groove 8 is adjusted in a desired manner by constraining the relative position of the first demarcation profile 10, 10' and of the upper profile 4.

Advantageously, the first demarcation profile 10' could delimit a margin 20 of a second longitudinal groove 18 for slidingly receiving a second lift door.

Preferably, the sill 1' could comprise a second demarcation profile 22 alongside the first demarcation profile 10' so that a margin 24 of the second demarcation profile defines part of the second longitudinal groove 18.

In this case, the sliding transversal cross-section of the second longitudinal groove 18 could be adjusted in a desired manner by constraining the relative position of the demarcation profiles 10', 22.

Innovatively, the aforesaid sill and aforesaid procedure allow resolving the drawbacks of the prior art.

More precisely, this method reduces the risk of inaccuracies during assembly, and further allows using the same method for a high variety of lift doors of different thickness.

Advantageously, the aforesaid sill and aforesaid procedure allow using a smaller number of components compared to the sills of the prior art, for the same performance.

Advantageously, the components of the sill covered by this invention are designed to be approached in a transitory but stable way, and to then be fixed with great accuracy in the final steps.

Advantageously, the sill and procedure covered by this invention are designed to employ semi-finished products of great availability, and consequently of low cost.

Advantageously, the sill and procedure covered by this invention allow using profiles with a reduced number of bends, so as to reduce the risk of imperfections.

Even in case of imperfect bending, in any case, this sill allows good assembly capacity and a more than satisfactory functionality.

To the embodiments of the aforesaid procedure and sill, one skilled in the art, in order to meet specific needs, may make variants or substitutions of elements with others functionally equivalent.

Even these variants are contained within the scope of protection, as defined by the following claims.

Moreover, each of the variants described as belonging to a possible embodiment can be performed independently of the other variants described.

The invention claimed is:

1. Method for the manufacture of a sill for a lift door comprising the steps of:

providing at least one support element and an upper profile, which extends along a main direction of extension and which defines at least a boundary surface of a first longitudinal groove for a slidable housing of a lift door;

joining the support element and the upper profile;

placing a first demarcation profile alongside the upper profile, so that a boundary surface of said first demarcation profile delimits part of the first longitudinal groove;

adjusting a transversal sliding cross-section of the first longitudinal groove by approaching/distancing said boundary surfaces;

once a desired transversal sliding cross-section has been obtained, constraining a relative position of the first demarcation profile and of the upper profile;

wherein the upper profile comprises a free edge, wherein the first demarcation profile delimits a recess in which the free edge is at least partially housed, the free edge and the recess being mutually shaped in such a way that, before the step of constraining, said edge has a clearance inside said recess, and wherein the mouth of said recess is oriented with respect to the free edge so that, before the step of constraining, the first demarcation profile is hooked to the free edge of the upper profile, the first demarcation profile being transversely movable to adjust a desired transversal sliding cross-section; and wherein the first demarcation profile delimits a margin of a second longitudinal groove for slidingly receiving a second lift door, said method comprising the steps of:

placing a second demarcation profile alongside the first demarcation profile, so that a margin of the second demarcation profile defines part of the second longitudinal groove;

adjusting a transversal sliding cross-section of the second longitudinal groove by approaching/ distancing said margins;

once a desired transversal sliding cross-section has been obtained, constraining the relative position of the demarcation profiles.

2. Method according to claim 1, wherein the first demarcation profile and the upper profile are shape-coupled to each other.

3. Method according to claim 2, wherein the upper profile and the first or second demarcation profile, delimit walkable surfaces of said sill.

4. Method according to claim 2, wherein the step of constraining comprises a step of joining the demarcation profile to the support element.

5. Method according to claim 1, wherein said edge has the clearance inside said recess in a transverse direction to the main direction of extension.

6. Method according to claim 1, wherein the sliding transversal cross-sections of the first and of the second longitudinal groove are adjustable independently of each other.

7. Method according to claim 6, wherein the step of constraining comprises a step of welding the demarcation profile to the support element.

8. Method according to claim 1, wherein the boundary surfaces and/or margins extend in an incident or orthogonal manner to a bottom surface of the first and/or of the second longitudinal groove.

9. A sill for lift doors comprising:

an upper profile, which extends along a main direction of extension and which defines at least one boundary surface of a first longitudinal groove for a slidable housing of a lift door;

a support element joined to the upper profile;

a first demarcation profile alongside the upper profile, so that a boundary surface of said demarcation profile delimits part of the first longitudinal groove;

the sliding transversal cross-section of the first longitudinal groove being adjusted in a desired manner by constraining a relative position of the first demarcation profile and of the upper profile;

wherein the upper profile comprises a free edge, wherein the first demarcation profile delimits a recess in which the free edge is at least partially housed, the free edge and the recess being mutually shaped in such a way that said edge has a clearance inside said recess, and wherein the mouth of said recess is oriented with respect to the free edge so that the first demarcation profile is hooked to the free edge, but transversely movable to adjust the desired transversal sliding cross-section; and wherein the first demarcation profile delimits a margin of a second longitudinal groove for slidingly receiving a second lift door, said sill comprising a second demarcation profile alongside the first demarcation profile so that a margin of the second demarcation profile defines part of the second longitudinal groove; the sliding transversal cross-section of the second longitudinal groove being adjusted in a desired manner by constraining the relative position of the demarcation profiles.

10. Sill according to claim 9, wherein the first demarcation profile and the upper profile are shape-coupled to each other.

11. Sill according to claim 9, wherein the upper profile and the first demarcation profile or the second demarcation profile delimit walkable surfaces of said sill.

12. Sill according to claim 9, wherein the boundary surfaces and/or margins extend in an incident manner or orthogonal manner to a bottom surface of the first longitudinal groove and/or the second longitudinal groove.

13. Sill according to claim 9, comprising a single support element in the form of a profile which extends along or parallel to the main direction of extension.

14. Sill according to claim 9, wherein the support element delimits at least a passing adjustment slot, to which a locking nut of the sill to a lift shaft is attached in a slidable manner, said nut being joined to a sliding member movable along said slot.

* * * * *